United States Patent [19]

Kohl et al.

[11] 4,398,124

[45] Aug. 9, 1983

[54] ELECTRIC LAMP UNIT WITH IMPROVED FUSE MEANS

[75] Inventors: Clyde B. Kohl, Winchester; Raymond T. Fleming, Lexington, both of Ky.

[73] Assignee: GTE Products Corporation, Stamford, Conn.

[21] Appl. No.: 319,344

[22] Filed: Nov. 9, 1981

[51] Int. Cl.[3] ..... H01J 7/44

[52] U.S. Cl. ..... 315/74; 174/84 C; 315/58; 315/362

[58] Field of Search ..... 315/58, 73, 362; 174/84 C; 337/198, 208, 227, 252

[56] References Cited

U.S. PATENT DOCUMENTS

| | | | |
|---|---|---|---|
| 1,404,323 | 1/1922 | Rohn | 337/208 |
| 2,156,988 | 5/1939 | Jancke et al. | 315/74 |
| 2,332,345 | 11/1943 | Steinmayer | 337/252 |
| 2,494,917 | 1/1950 | Van Liempt | 315/74 |
| 2,806,215 | 9/1957 | Redslob | 174/84 C |
| 3,727,091 | 4/1973 | DeCaro et al. | 313/222 |
| 3,796,914 | 3/1974 | DeCaro et al. | 313/315 |

*Primary Examiner*—Harold A. Dixon

*Attorney, Agent, or Firm*—Lawrence R. Fraley

[57] ABSTRACT

An improved fuse means for use within an electric incandescent lamp (e.g., tungsten halogen). The fuse is located within a ceramic base to which the press-sealed end of the envelope is affixed (e.g., cemented). The improved fuse means comprises a first conductive (e.g., nickel) wire segment of rectangular cross-sectional configuration and a second conductive (e.g., nickel) sleeve member crimped about an end portion of the first wire segment and including a flat region which in turn is fixedly secured (e.g., welded) to one of the lead-in wires projecting from the lamp's press-sealed end portion. In an alternative embodiment, a second sleeve member and conductive wire segment is utilized.

9 Claims, 5 Drawing Figures

ELECTRIC LAMP UNIT WITH IMPROVED FUSE MEANS

DESCRIPTION

1. TECHNICAL FIELD

This invention relates to fuse means for utilization in electric lamp units, and particularly to fuse means which are located externally of the lamp envelope which forms part of the unit. Even more particularly, the invention relates to fuse means of the type described for use within electric lamps which include an incandescent filament therein.

2. BACKGROUND

The use of fuses in combination with electric lamps is well documented. See, e.g. U.S. Pat. Nos. 3,727,091 (A. R. DeCaro) and 3,796,914 (A. R. DeCaro et al) wherein it is taught to utilize a fuse component internally within the envelope portion of a multiple projection lamp, said fuse element being electrically connected to two of the lamp's internally positioned upright rigid conductors. Typically, lamps of this variety are of the tungsten-halogen type containing therein a gas, such as argon or nitrogen, which is inert with respect to the internally positioned tungsten filament, as well as an additional gas such as iodine which reduces discoloration of the lamp's envelope. The filament, often of the coiled-coil type, is in turn supported by the internal rigid conductors which pass through a press-sealed end portion of the lamp's glass envelope. Alternatively, these conductors may in turn be electrically joined within the press-sealed end to a corresponding pair of molybdenum flat ribbons which in turn are electrically connected to a corresponding pair of projecting lead wires, said wires extending (projecting) from the press-sealed end. Typically, the entire unit further includes an electrically insulative base member in which is securedly positioned (e.g., using Saurelsen cement) the press sealed end of the lamp envelope. Understandably, each of the aforedescribed lead-in wires projecting from the press sealed end of the envelope are in turn electrically connected to a respective one of the aforedescribed pin members projecting from the ceramic base.

When the tungsten filament used in a lamp of the type defined burns out (fails) after its useful life, an arc is likely to start between the broken ends thereof, or from a lead-in conductor to such a broken end, or to the other lead-in conductor. Such an arc has a negative resistance and, because of this, the current therethrough may generally increase to the point that the glass envelope of the lamp is damaged, even to the point of fracture. Accordingly, a fuse means is utilized within the lamp unit's circuit to limit the arc current in a relatively safe value.

The use of a fuse means within the lamp envelope is generally impractical, particularly in smaller type lamps in view of the necessity for providing protection or covering for the fuse wire. Examples are illustrated in the aforementioned U.S. Patents. In U.S. Pat. No. 3,727,091, it is necessary to provide a platinum coating about the fuse wire, said coating of substantial thickness in order to protect the fuse wire from the hot corrosive atmosphere typically found within operating lamps of the tungsten halogen variety. This thickness thus prevents diffusible core metal from contaminating the lamp and disrupting the halogen-regenerative cycle. In U.S. Pat. No. 3,796,914, the fuse wire is encased within a glass sleeve to provide substantially the same results as in U.S. Pat. No. 3,727,091. In view of the above added requirements, as well as the aforementioned spacing limitations, an internally positioned fuse is not desirable.

In U.S. Pat. No. 3,274,426 (R. F. Scoledge et al), there is shown and described the use of an externally positioned fuse wire, said wire located within a ceramic cap which in turn is securedly positioned to a sealed end of the lamp unit's glass envelope. The ceramic cap is hollow, having the fuse wire inserted between a lead-in conductor extending slightly out of the flattened glass end of the envelope and a contact button held by the ceramic cap. The cap includes a slot which fits over the flattened end of the envelope and is cemented in place. An inner ceramic tube surrounds part of the fuse and holds the contact button in place between itself and the ceramic cap, the latter having an opening through which connection can be made from the outer circuit to the contact. A nickel wire is used and includes a first, somewhat large diameter portion which is welded to one of the lead-in wires projecting from the lamp's pressed end and a smaller diameter portion buttwelded to the larger diameter portion and acting as a fuse. The fuse wire in turn is welded to the flat side portion of the contact member located within the ceramic end cap.

In external fuse arrangements of the type described in U.S. Pat. No. 3,274,426 wherein the fuse wire is buttwelded to other wire portions or conductive members, mechanical failures have been known to occur. This occurrence typically happens when the glass envelope (capsule) is positioned and/or repositioned within the respective insulative base to accomplish centering of the tungsten filament light source at the precise distance from the base structure. Understandably, such an occurrence results in the finished lamp unit failing to operate.

It is believed, therefore, that a fuse means for use within an electrical lamp unit which possesses substantially greater mechanical strength than those of the buttwelded variety such as described in U.S. Pat. No. 3,274,426, and which can be positively retained within an insulative base member forming part of the lamp unit would constitute a significant advancement in the art.

DISCLOSURE OF THE INVENTION

It is, therefore, a primary object of the present invention to enhance the electric lamp unit art by providing an external fuse means of substantially greater mechanical strength than fuse means of the prior art.

It is another object of the invention to provide such a fuse means which is externally located from the lamp's glass envelope and which can also be securely positioned within an insulative base member forming part of the overall lamp unit.

It is still another object of the invention to provide a fuse structure which can be produced in an inexpensive and facile manner.

In accordance with one aspect of the invention, there is provided an improved fuse means for use within an electric lamp unit which in turn includes an electric lamp having an envelope with a filament therein, at least one sealed end portion, and at least one electrically conductive lead-in wire projecting from the sealed end portion, and an insulative base member including at least one electrically conductive pin projecting therefrom. The press-sealed end portion of the lamp envelope is affixed (e.g., cemented) to the insulative base. The improved fuse means, designed to prevent the formation of a destructive arc when the filament located within the lamp's envelope fails, comprises a conductive wire segment and a conductive sleeve member crimped about an end portion of the wire segment and including a substantially flat region, said sleeve member being affixedly secured (e.g., welded) to the lead-in wire at the flat region thereof.

BEST MODE FOR CARRYING OUT THE INVENTION

For a better understanding of the present invention, together with other and further objects, advantages, and capabilities thereof, reference is made to the following disclosure and appended claims in connection with the above-described drawings.

Figure 1:
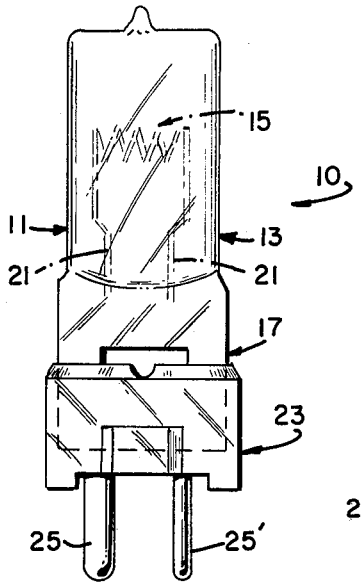
FIG. 1 is a front, elevational view of an example of an electric lamp unit in which the present invention may be successfully utilized.

With particular reference to FIG. 1, there is illustrated an example of an electric lamp unit 10 in which the subject invention may be utilized. It is to be understood that unit 10 is representative of only one of several varieties of electric lamps capable of successfully employing the fuse means of the instant invention. Accordingly, the scope of the invention is not to be limited to the particular lamp unit 10 as shown and described hereinbelow.

Lamp unit 10 includes an electric lamp 11 which has a tubular glass envelope 13 having a filament structure 15 therein. Lamp 11 is of the tungsten-halogen variety with envelope 13 containing therein a pressurized gas which is inert with respect to the filament 15. Suitable examples of such inert gas include argon and nitrogen. An additional gas, such as iodine, which reduces discoloration of the lamp envelope is also included within envelope 13. Envelope 13 may be of quartz or "Vycor" (the latter being a trademark used on glass of approximately 98% silica content and sold by the Corning Glass Works, Corning, N.Y.), while filament 15 is preferably of coiled or coiled-coil construction as is known in the art. Understandably, filament 15 is of tungsten material.

Lamps of the above variety are known today and recent developments have allowed the use of gases other than iodine within the lamp envelope. Examples of such gases include bromine and chlorine. More specifically, such gases are listed under the broad classification of elements known as halogens. Typically, the halogen gases sealed in the lamp reduce envelope blackening and maintain the color temperature for the life of the lamp. In operation, tungsten particles from the filament structure 15 evaporate and collide with the halogen gas particles, resulting in a chemical combination and formation of a halide. The halide in turn dissociates at high temperatures in the vicinity of the filament. Accordingly, tungsten particles are deposited on the filament and the halogen gas released to subsequently effect once again the described combination. The result of the above activity is a self-cleaning lamp which never darkens and yet produces maximum light output over its entire life. The described operation of tungsten halogen lamps is well known in the art and further description is, therefore, not believed necessary.

Lamps of this type are usually of either the single ended or double ended variety. With regard to the drawings, a single ended tungsten halogen lamp is shown in FIG. 1. It is understood that the invention may also be successfully utilized with double ended lamps, as well as several other varieties of electric lamps known in the art. By the term single ended is meant that one end of envelope 13 contains a press seal (17) through which the lead-in wires 19 (FIG. 2) project. This press seal is formed using known teachings in the art, further description not being necessary. Understandably, each of the illustrated lead-in wires 19 is in turn electrically connected to a respective one of the internally positioned conductive wires (21) on which is positioned the tungsten filament 15.

Lamp unit 10 further includes an insulative base member 23 (shown in phantom in FIG. 2) in which is securedly positioned a substantial portion of the press-sealed end 17 of envelope 13. Base 23 is preferably of ceramic material, for example, that known as "Steatite," and is affixed to press-sealed end 17 by a suitable refractory cement (e.g., Saureisen). In this arrangement, each of the projecting lead-in wires 19 from envelope 13 are electrically connected to a respective electrically conductive pin 25 or 25' which in turn projects from the bottom of the ceramic base. Each of these pins is in turn designed for being positioned within a corresponding socket which forms part of the electrical equipment in which lamp unit 10 is particularly suited for use. Typically, lamp units of the variety described herein are used in projection equipment such as 16 mm projectors, as well as slide viewers, overhead projectors, etc.

Specific examples of tungsten halogen electric lamps 11 which may be used as part of unit 10 include those under ANSI Code designations EHA, EGZ, EMG, BHC, DYV, DYS, DYH, FBD, FFX, DYP, BCK, EGH, DYY, FEL, FCV, FEP and EGV, to name a few. Electric lamps such as those under ANSI Code designations EHA and BHC operate at 120 volts, with corresponding wattage levels of 500–600 watts. These lamps possess an average life of about 75–100 hours and provide initial lumen levels of between 11,000 and 14,000 lumens. Filament structures used in these lamps include those known in the art under the designations CC6, CC8 and C13D. Although a tubular bulb type envelope 13 is illustrated, it is understood that tungsten halogen lamps of this variety may also possess a globular type, single ended envelope. Lamps such as those under ANSI Code designation FEL also operate at 120 volts, but at substantially greater wattage levels than those described above. By way of specific example, an FEL tungsten halogen lamp provides 1,000 watts over an average life of 300 hours, and also produces an initial lumen level of about 27,000 lumens. The preferred filament structure is of the CC8 (coiled-coil) variety. In addition to the above, lamps such as those under ANSI Code designation EGV also operate at 1,000 watts, 120 volts, but are capable of providing an initial lumen output of approximately 32,500 lumens. The preferred filament structure is of the C13D variety.

Specific examples of ceramic bases which may be successfully utilized with the above lamp types include those presently defined in the art as being of the two pin prefocus, two pin miniature, two button, trufocus, medium two pin, medium bi post, medium prefocus, mogul prefocus and mogul bi post types. By way of further example, two pin prefocus bases are preferably utilized with tungsten halogen lamps under ANSI Code designations EHA, EGZ, EMG, DYV, DYS and BHC. Two pin miniature bases may be used in combination with tungsten halogen lamps under ANSI Code designation DYH. By way of even further example, true focus bases may be utilized with tungsten halogen lamps under ANSI Code designation BCK, EGH and DYY, medium two pin bases may be used with lamps under ANSI Code designations FEL, FCV and FEP, and mediuim bi post bases may be successfully used with lamps under ANSI Code designation EGV.

It must again be emphasized that the above examples are only illustrative of several types of lamps and insulative bases in which the present invention may be successfully utilized. Accordingly, the scope of the invention is not meant to be limited to those defined.

When the filament structure in lamps such as those described above burns out (fails) after its useful life, an arc is likely to occur between the broken ends thereof or from a lead-in conductor (e.g., 21) to such a broken end. Such an arc possesses a negative resistance and the current through it may generally increase until the lamp envelope is damaged. To prevent such an occurrence, it is desirable to employ a fuse as part of the lamp unit's circuitry to limit the arc current to a safe value. With particular regard to FIGS. 2–5, there are illustrated fuse means which can be employed in lamp units such as that illustrated in FIG. 1 and which represent a subtantial improvement over fuses presently in use.

Figure 2:
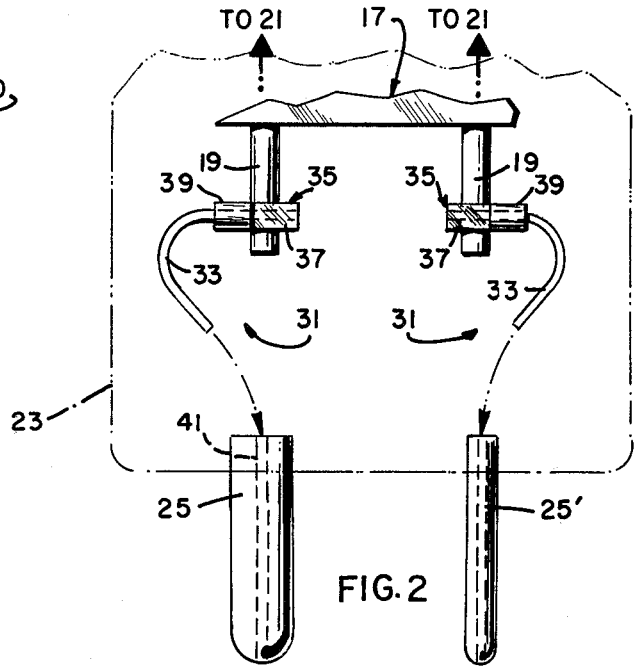
FIG. 2 is an enlarged, partial front elevational view depicting a pair of fuse means in accordance with a preferred embodiment of the invention, each of said fuse means being used to electrically interconnect the corresponding lead-in wires and pin members of the lamp unit shown in FIG. 1.

With particular reference to FIG. 2, a fuse means 31 in accordance with a preferred embodiment of the invention is illustrated. Actually, two of such means 31 are shown, each means being designed to electrically interconnect one of the projecting laed-in wires 19 from envelope 13 to a corresponding conductive pin (25 or 25') which in turn projects from ceramic base 23. It is understood with regard to the invention that only a single fuse means 31 can be employed per lamp unit 10. Two of these means are preferably used, however, to provide an additional safety factor.

Figure 3:
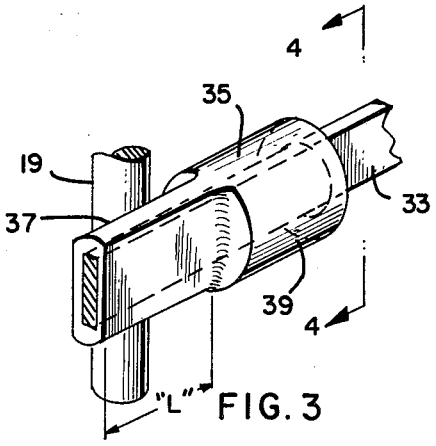
FIG. 3 is an enlarged, partial perspective view illustrating the sleeve member and crimped end portion of the conductive wire segment of the invention.

Each fuse means 31 includes a conductive wire segment 33 and a conductive sleeve member 35 crimped about an end portion of wire segment 33. Both the wire segment 33 and conductive sleeve 35 are preferably of nickel. As shown in FIG. 3, sleeve member 35 is crimped to the first end portion of the substantially flat (rectangular in cross section) wire segment 33 so as to define a flattened region at the end thereof. Flat region 37 is in turn welded along the entire width thereof to a respective one of the lead-in wires 19. Sleeve 35 is originally of cylindrical configuration and thus includes a remaining cylindrical end portion 39 following the aforedescribed crimping about the extreme end of segment 33. The opposing non-crimped end of wire segment 33 is preferably inserted within a corresponding opening 41 (hidden) located in the upper end of a respective one of the conductive pins (25 or 25') and passing therethrough. This arrangement is illustrated by the dashed lines in FIG. 2. Electrical connection between the opposing (non-crimped) end of segment 33 and the respective pin is further enhanced by the addition of solder (e.g., silver or lead) at the lower (tip) end region of the pin. Use of the crimped arrangement as shown and described for each of the fuse means 31, in combination with the insertion of the opposing ends of the wire segment within an end of a respective pin member, has resulted in a fuse arrangement possessing substantially greater mechanical strength than fuses utilizing butt-welding to provide interconnection. The fuse means of the invention is thus able to better withstand application of external forces such as those typically incurred during positioning and/or repositioning of the lamp envelope 13 within base 23. Provision of a flat region such as region 37 in FIG. 3 at the extreme end of the fuse also assures a substantially larger area along which fixed securement (welding to the corresponding lead-in wire) can be accomplished, particularly when the elongated nickel sleeve 35 is positioned perpendicular to the lead-in conductor 19 in the manner shown.

Figure 4:
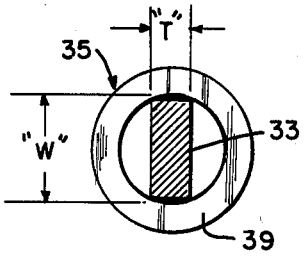
FIG. 4 is a side elevational view, partly in section, of the sleeve member and conductive wire segment of the invention, as taken along the line 4—4 in FIG. 3.

Wire segment 33, as shown in FIG. 4, is preferably of rectangular cross-sectional configuration. By way of specific example, a wire segment 33 having a length of about 15 mm, a width (dimension "W" in FIG. 4) of 0.508 mm, and a thickness (dimension "T" in FIG. 4) of 0.127 mm was successfully utilized in a tungsten halogen lamp under ANSI Code designation EHA, said lamp seated within a two pin prefocus base and operating at 120 volts with a wattage output of 500 watts. The corresponding sleeve possessed an original (prior to crimping) external diameter of 1.12 mm and the corresponding internal diameter of 0.610 mm. The extreme end portion of segment 33 was thus able to be readily positioned within the cylindrical sleeve 35 prior to crimping thereof.

By way of further example, a 15 mm nickel wire segment 33 having a width of 0.508 mm and a thickness of 0.178 mm was successfully utilized in a 600 watt, 120 volt tungsten halogen lamp under ANSI Dode designation DYH, said lamp secured within a miniature two pin ceramic base. Sleeve 35, in accordance with one embodiment of the invention, possessed a length of about 2.5 mm. In addition, the non-crimped end of wire segment 33 was inserted a total distance of about 10 mm within the end of a corresponding conductive pin (25). Accordingly, only approximately 2.5 mm of wire segment 33 was positioned externally of the crimped sleeve 35 and corresponding conductive pin. The relationships illustrated in the drawing, therefore, are for illustrative purposes only and are not meant to limit the invention to the scale depicted.

As stated, sleeve 35 possessed an overall length of approximately 2.5 mm. Of this, the flat region 37 was approximately 1.25 mm long (illustrated as dimension "L" in FIG. 3).

Lead-in wires 19 as typically used in tungsten halogen lamps are molybdenum and of cylindrical configuration such as illustrated. In lamps of the variety described above, lead-in conductors 19 may possess an external diameter of about 0.762 mm. In turn, the corresponding conductive pins projecting from the ceramic base 23 are of differing external diameters to in turn assure proper positioning of the base relative to corresponding projection unit socket. By way of example, pin 25 may be nickel-plated copper and of a cylindrical configuration, and having an external diameter of 3.2 mm, whereas the smaller diameter pin (25') may also be of nickel-plated copper but have an external diameter of only 2.36 mm.

Figure 5:
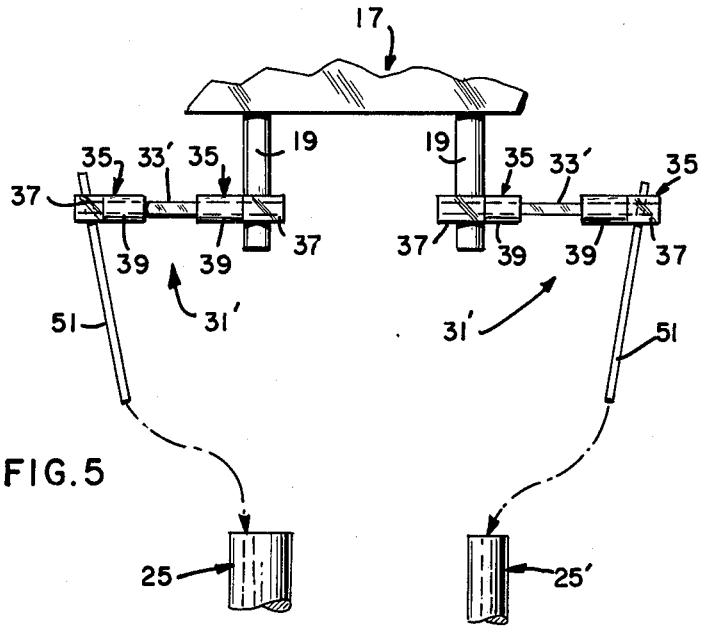
FIG. 5 is a partial, front elevational view of a pair of fuse means in accordance with an alternate embodiment of the invention.

With particular attention to FIG. 5, there is illustrated a pair of fuse means 31' in accordance with an alternate embodiment of the invention. Each means 31' includes a pair of the aforedescribed conductive sleeve members 35 clamped about opposing ends of a first conductive wire segment 33'. Wire segment 33' is preferably of a rectangular cross sectional configuration similar to that of segment 33 in FIGS. 2–4, while each of the sleeve members 35 is also of substantially the same configuration as that depicted in FIG. 3. Sleeves 35 of each fuse means 31 are oriented such that the flat regions 37 thereof are arranged at extreme ends of each segment 33'. The flat region of each of the first sleeve members is in turn welded to one of the corresponding lead-in wires 19 in the same manner as described in FIG. 2. The remaining, opposing flat region 37 of the second sleeve member is spot welded to a second condutive wire segment 51 which in turn is positioned within the end of the corresponding conductive pin in the manner shown as with segments 33 in FIG. 2. Solder is also used to enhance the electrical connection between segments 51 and the corresponding pin members.

By way of specific example, each conductive wire segment 33' possessed an overall length of 11 mm, and a corresponding width of 0.508 mm and thickness of 0.229 mm. The corresponding second wire segment 51 was preferably of nickel material and possessed an overall length of between 15 to 18 mm, with approximately 10 mm of this being inserted and soldered within the corresponding conductive pin. Each second wire segment 51 was preferably of cylindrical configuration and possessed an external diameter of from about 0.508 mm to about 0.620 mm.

In one specific example, a pair of fuse means 31' was successfully utilized in a lamp unit wherein the tungsten halogen lamp was of the ANSI Code designation FEL (1,000 watts, 120 volt), having an insulative (ceramic) base of the medium two pin variety. A CC8 tungsten filament was used. In addition to the above, a pair of fuse means 31' wherein the first wire segment 31' of each possessed an overall thickness of 0.229 mm was also successfully used.

There has thus been shown and described a new and improved fuse means for use within an electric, incandescent lamp unit to prevent destruction of the lamp envelope in the event that the lamp's filament structure should fail. The fuse means as described and illustrated above possesses substantially greater mechanical strength than fuse means of the present art and can also be produced in an inexpensive and facile manner. The fuse means of the invention, whether in the single or double embodiment, also enables much greater flexing of the lead components during assembly and/or operation of the corresponding lamp unit.

While there have been shown and described what are at present considered the preferred embodiments of the invention, it will be obvious to those skilled in the art that various changes and modifications may be made therein without departing from the scope of the invention as defined by the appended claims. For example, it is within the scope of the invention to provide a first wire segment (e.g., 33 or 33') of cylindrical cross-sectional configuration. The cross sectional area for such a member, if of a length similar to that described above, could also be substantially similar to that of the rectangular embodiments shown.

What is claimed is:

1. In an electric lamp unit including an electric lamp having an envelope with a filament therein, at least one sealed end portion, and at least one electrically conductive lead-in wire projecting from said sealed end portion, an insulative base member including at least one electrically conductive pin projecting therefrom, said sealed end portion of said electric lamp being affixed to said base member, and fuse means located substantially within said base member and electrically interconnecting said lead-in wire and conductive pin for preventing the formation of a destructive arc when said filament within said lamp envelope fails, the improvement wherein said fuse means comprises:

a conductive wire segment; and a conductive sleeve member crimped about an end portion of said wire segment and including a crimped substantially flat region and a substantially cylindrical region adjacent said flat region, said sleeve member fixedly secured to said lead-in wire at said crimped flat region.

2. The improvement according to claim 1 wherein said sleeve member of said fuse means is fixedly secured to said lead-in wire by welding.

3. The improvement according to claim 1 wherein said conductive wire segment of said fuse means is of substantially rectangular cross-sectional configuration.

4. The improvement according to claim 1 wherein the number of lead-in wires projecting from said sealed end portion of said lamp is two, the number of said conductive pins projecting from said base member is two, and the number of said fuse means is two, each of said fuse means electrically interconnecting one of said lead-in wires and a respective one of said conductive pins.

5. The improvement according to claim 4 wherein each of said fuse means includes a second conductive sleeve member crimped about a second, opposing end portion of said first wire segment and a second conductive wire segment fixedly secured to said second conductive sleeve member.

6. The improvement according to claim 5 wherein said second conductive sleeve member includes a substantially flat region, said second sleeve member being fixedly secured to said second conductive wire segment at said flat region.

7. The improvement according to claim 6 wherein said second conductive sleeve member is fixedly secured to said second conductive wire segment by welding.

8. The improvement according to claim 1 said fuse means further includes a second conductive sleeve member crimped about a second, opposing end portion of said first wire segment and a second conductive wire segment fixedly secured to said second conductive sleeve member.

9. The improvement according to claim 1 wherein said conductive wire segment and said conductive sleeve member are each comprised of nickel.

* * * * *